United States Patent [19]

Garber

[11] Patent Number: 4,901,489

[45] Date of Patent: Feb. 20, 1990

[54] LOG FOR CONSTRUCTING LOG STRUCTURES AND ASSOCIATED LOG FABRICATING PROCESS

[75] Inventor: Thomas R. Garber, Sevier County, Tenn.

[73] Assignee: Heritage Log Homes, Inc., Gatlinburg, Tenn.

[21] Appl. No.: 41,607

[22] Filed: Apr. 23, 1987

[51] Int. Cl.[4] ..... E04B 1/10

[52] U.S. Cl. ..... 52/233; 144/368

[58] Field of Search ..... 52/233; 446/106

[56] References Cited

U.S. PATENT DOCUMENTS

| | | | |
|---|---|---|---|
| 1,334,121 | 3/1920 | Stenberg | 52/578 |
| 2,238,039 | 4/1941 | De Witt | 446/106 X |
| 3,381,428 | 5/1968 | Sillman | 52/233 |

FOREIGN PATENT DOCUMENTS

| | | | |
|---|---|---|---|
| 35765 | 12/1966 | Finland | 52/233 |
| 213847 | 6/1967 | Sweden | 52/233 |

*Primary Examiner*—Carl D. Friedman

*Attorney, Agent, or Firm*—Pitts and Brittian

[57] ABSTRACT

An improved log (10) for interlocking with other logs (10) for the construction of log structures, and an associated fabricating process. The log (10) comprises an elongated body (12) having first and second opposite end portions (14 and 16), a top portion (18) and a bottom portion (20). At least one downwardly oriented saddle notch (34) is provided in the bottom portion (20) of the body (12) for closely receiving the top portion (18) of another log (10). Each saddle notch (34) defines an interior surface (40) carrying at least one tongue (42), and above each saddle notch (34) at least one groove (44) is provided in the top portion (18) of the body (12) for closely receiving the tongue (42) of another log (10) such that a plurality of logs (10) can interlock to form strong, well insulated corner joints. The associated process for fabricating the log (10) generally comprises the steps of cutting at least one such saddle notch in the body (12) of the log (10) and cutting at least one groove (44) in the body (12) above the saddle notch (34).

18 Claims, 3 Drawing Sheets

LOG FOR CONSTRUCTING LOG STRUCTURES AND ASSOCIATED LOG FABRICATING PROCESS

TECHNICAL FIELD

This invention relates to an improved log for interlocking with other logs for constructing log structures, and an associated log fabrication process. The improved log of the present invention generally comprises a body provided on its bottom portion with at least one improved saddle notch for engaging the top portion of another improved log.

BACKGROUND ART

In the construction of the traditional log structure, logs are stacked one upon the other to form the walls of the structure with a sealing material packed in the seams between logs to seal any gaps between logs. Where two walls intersect, the logs of each wall are provided with downwardly disposed saddle notches which are designed to closely receive the upper portion of a log of the intersecting wall. Thus, at the corner joints of the structure the logs of intersecting walls alternately interlock, with the saddle notch of the log of one wall engaging the top portion of the log of the intersecting wall. Whereas, this traditional construction method normally produces a strong durable structure, such structures tend to be poorly insulated. For the most part, this is a result of the logs simply being stacked one upon another with the only insulating barrier between the logs being the sealing material. This insulating problem is particularly acute at the corner joints where logs of intersecting walls interlock. Further, because the traditional process involves the simple stacking of logs with no specific engaging means being provided for locking the logs together other than the sealant, proper alignment of the logs to produce true vertical walls and perpendicular corner joints can be difficult and time consuming to achieve.

Therefore, it is an object of the present invention to provide an improved log for constructing log structures and an associated log fabricating process.

Another object of the present invention is to provide an improved log having a tongue and groove along its top and bottom portions, respectively, for engaging other such improved logs to effect a more durable, better insulated log structure, and to provide a fabricating process for such improved log.

Yet another object of the present invention is to provide an improved log having an improved saddle notch for producing durable, better insulated, corner joints for log structures.

Still a further object of the present invention is to provide an improved log which is self-truing such that proper alignment of the walls of a log structure is facilitated, and to provide a fabricating process for such logs.

It is also an object of the present invention to provide an improved log which is inexpensive to fabricate and results in log structures which are inexpensive to construct and maintain.

DISCLOSURE OF THE INVENTION .

Other objects and advantages will be accomplished by the present invention which provides an improved log for interlocking with other logs for the construction of log structures, and an associated process for fabricating such logs. The improved log of the present invention comprises an elongated body defining a longitudinal axis and having first and second opposite end portions, a top portion and a bottom portion. At least one downwardly oriented saddle notch is provided in the bottom portion of the body for closely receiving the top portion of another log of the present invention. More specifically, each saddle notch defines an interior surface carrying at least one tongue, and above each saddle notch at least one groove is provided in the body of the log for closely receiving the tongue of another improved log such that logs of the present invention interlock to form strong, well insulated, corner joints. Moreover, the process of fabricating such improved logs comprises the steps of cutting at least one such saddle notch in the body of the log and cutting at least one such groove in the body of the log above the saddle notch.

BRIEF DESCRIPTION OF THE DRAWINGS

The above-mentioned features of the present invention will become more clearly understood from the following detailed description of the invention read together with the drawings in which.

BEST MODE FOR CARRYING OUT THE INVENTION

Figure 1:
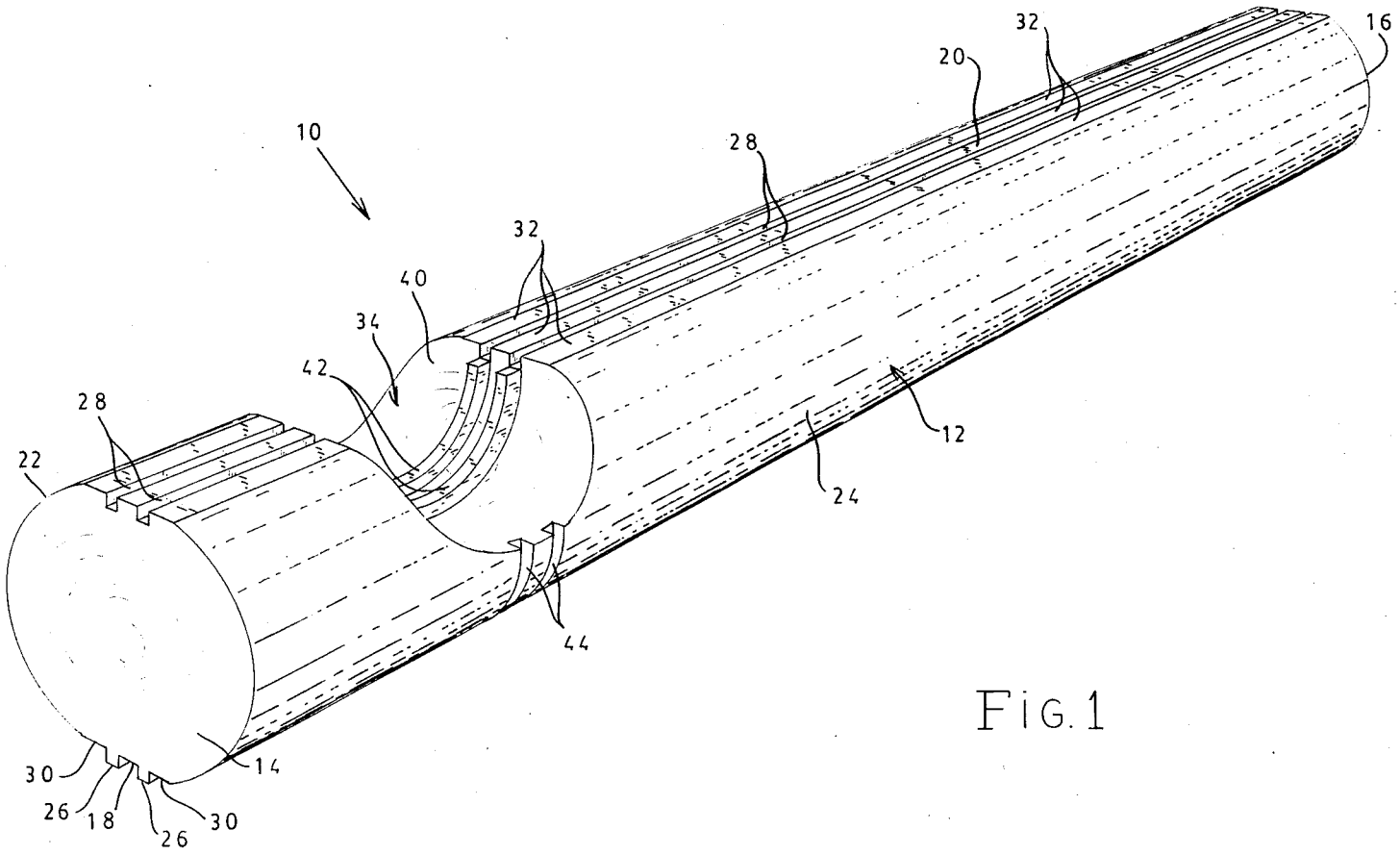
FIG. 1 illustrates a perspective view of an improved log of the present invention.

An improved log incorporating various features of the present invention is illustrated generally at 10 in FIG. 1. The log 10 is utilized in the construction of log structures such as homes, barns and commercial buildings. In this regard, it will be understood by those skilled in the art that in the construction of log structures, a plurality of the logs 10 are stacked one upon another to form the walls of the structure with the logs of intersecting walls interlocking to provide corner joints. Moreover, it will be understood that the logs 10 are preferably fabricated of a strong, durable wood, as for example, yellow pine.

Referring now to FIG. 1, it will first be noted that the log 10 of FIG. 1 is illustrated in an inverted position with the bottom portion 20 facing up. As illustrated, the log 10 comprises an elongated body 12 having first and second opposite end portions 14 and 16, respectively. Further, the body 12 defines a top portion 18, a bottom portion 20, and opposite side portions 22 and 24. In order to facilitate the securing of the logs 10 on top of one another to form a wall, a pair of longitudinally oriented tongues 26 are provided on the top portion 18 of the log 10 and a pair of longitudinally oriented grooves 28 are provided on the bottom portion 20, the grooves 28 being disposed so as to register with the tongues 26 of another log 10. Further, it will be noted that in the preferred illustrated embodiment, the top portion 18 and the bottom portion 20 of each log 10 define the planar engaging surfaces 30 and 32, respectively, which facilitate the stable stacking of the logs 10 to produce a strong, durable wall.

Figure 2:
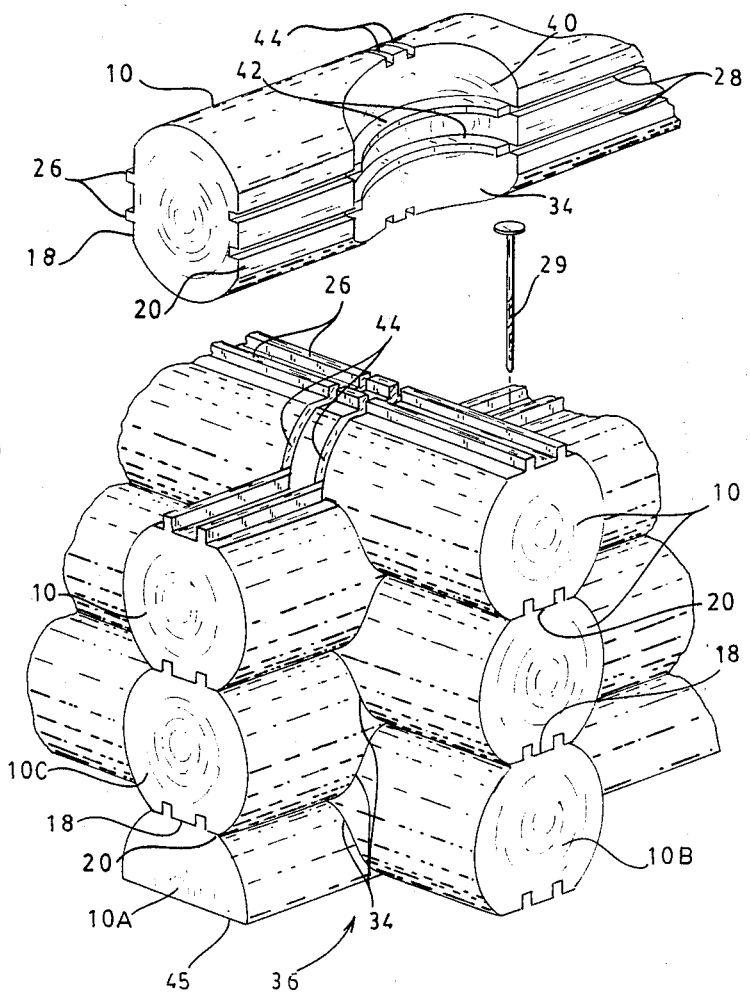
FIG. 2 illustrates a perspective view of a plurality of improved logs of the present invention which have been interlocked as in the construction of a log structure.

Thus, as illustrated in FIG. 2, the logs 10 can be stacked with the bottom portion 20 of one log 10 engaging the top portion 18 of the log 10 beneath with the tongues 26 of the lower log 10 seated in the grooves 28 of the upper log 10. The spikes 29 or other suitable fastening means are then used to secure the logs 10 together. It will be appreciated that this double tongue and groove securing system not only provides for the stable positioning of the logs 10 such that lateral movement is prohibited, it also facilitates the proper alignment of the logs 10 during construction and provides a well insulated joint between the logs 10. In this regard, when joined, with the tongues 26 seated in the grooves 28, the logs 10 produce a solid wall with no gaps or cracks which must be filled with sealing material, although a gasket or sealing material can be used between the logs 10 to further insulate the wall if desired.

In order to provide for the interlocking of the logs 10 to produce corner joints where differently oriented walls of a structure meet, the log 10 is provided on its bottom portion 20 with one or more saddle notches 34 for closely receiving the top portion 18 of another log 10 of an intersecting wall. Thus, as illustrated in FIG. 2, the saddle notch 34 of the log 10B receives the top portion 18 of the log 10A, and the saddle notch 34 of log 10C receives the top portion 18 of the log 10B, etc., to produce the corner joint 36. Further, it will be noted that in order for the intersecting walls to properly engage the foundation of the log structure, the log 10A comprises a log 10 which has been cut longitudinally to remove the bottom portion 20 of the log such that a lower surface 45 is defined for engaging the foundation. Of course, whereas the illustrated saddle notches 34 are disposed proximate the opposite end portions 14 and/or 16 of the logs 10, it will be understood that when necessary, the saddle notches 34 can be provided at various locations along the bottom portion 20 of the log 10 to provide for the interlocking of an intersecting wall.

Each of the saddle notches 34 of the logs 10 defines a concaved interior surface 40 provided with a pair of longitudinally disposed tongues 42 which, in the preferred embodiment, extend across the surface 40 such that the tongues 42 terminate at opposite sides of the saddle notch 34 at the bottom of the grooves 28, or at, or proximate, the engaging surface 32. Further, the log 10 defines one or more pairs of laterally disposed grooves 44 for registering with and closely receiving the tongues 42 of another log 10. In the preferred embodiment, the grooves 44 extend from the edge of the notch 34 on the side portion 22 of the log 10, across the top portion 18, to the edge of the notch 34 on the opposite side portion 24. Thus, as two logs 10 are interlocked in the construction of a corner joint, the saddle notch of the upper log 10 receives the top portion 18 of the lower log 10 such that the tongues 42 of the upper log 10 are closely received in the grooves 44 of the lower log 10.

As will be understood by those skilled in the art, the tongues 42 and grooves 44 serve to stabilize and lock the logs 10 in place as they intersect at the corner of a structure, thereby producing a stronger structure. Moreover, a better insulated corner is produced, obviating the need for an insulating gasket or sealant between the notch surface 40 and the upper portion 18 of the log 10 which the notch 34 engages, although such a gasket or sealant can be utilized if desired to provide an even more secure seal. Also, as is discussed below, the tongues 42 and grooves 44 are preferably precut at the proper location prior to assembly of the structure, and, thus, proper alignment of the interlocking logs 10 is automatically achieved as the tongues 42 of one log 10 are received in the grooves 44 of another log 10 making the logs 10 essentially self-truing.

Figure 3:
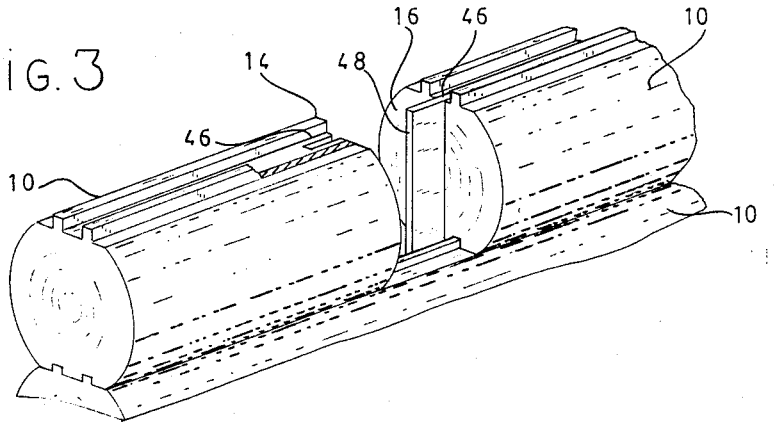
FIG. 3 is a perspective view of improved logs of the present invention illustrating the means for joining the end portions of such logs.

Referring now to FIG. 3, it will be understood that often the log 10 is shorter in length than the wall into which it is incorporated, and must be joined end to end with another log 10. In order to accommodate the joining of the logs 10, either or both end portions 14 and 16 can be provided with a dado groove 46 for closely receiving a dado block 48. Thus, as illustrated, the dado block is received in the registering grooves 46 of the logs 10 and hold the two logs together in proper alignment and also forms an insulating barrier at the point where the logs 10 are joined.

Figure 4:
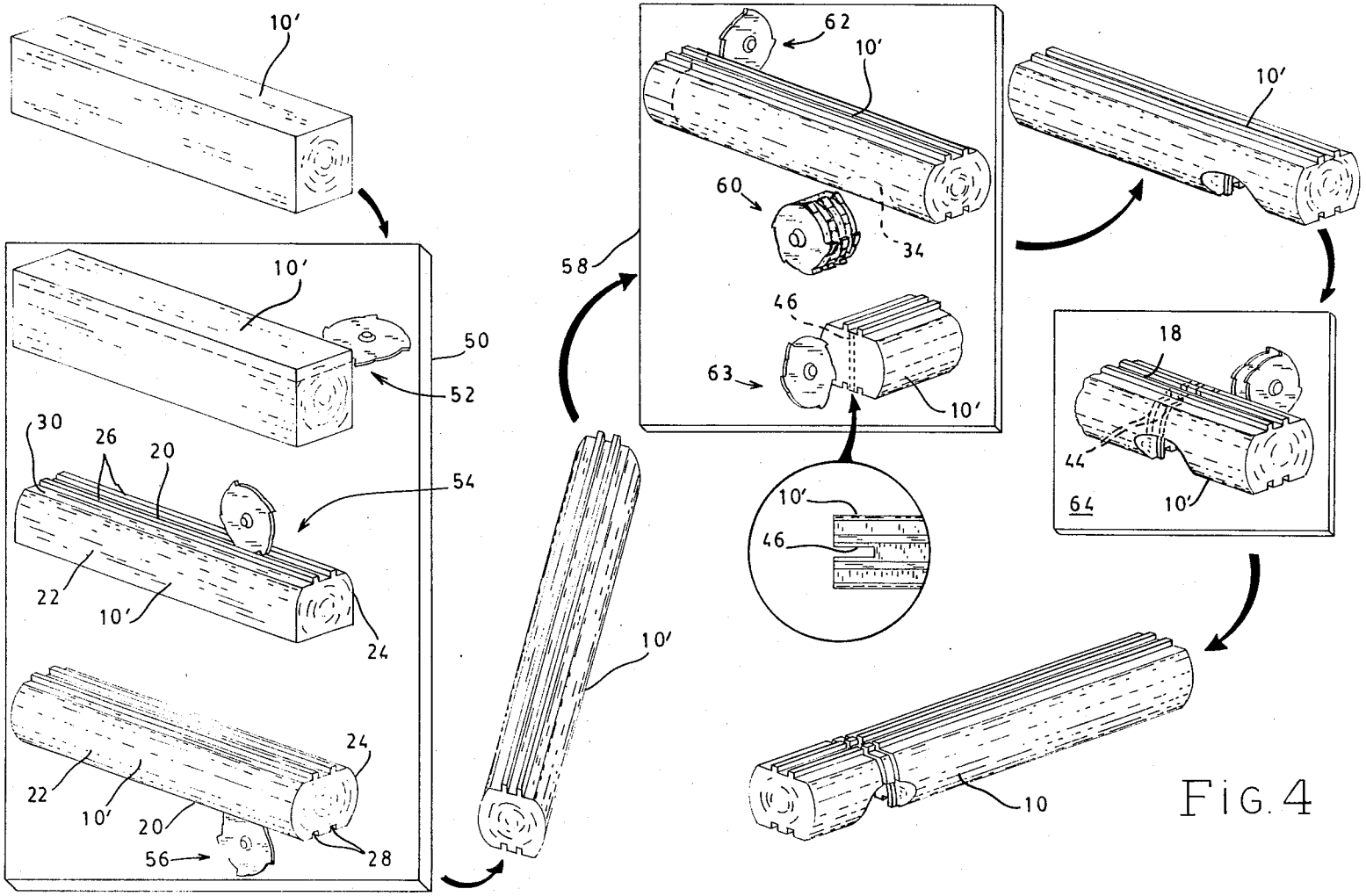
FIG. 4 illustrates a diagrammatic illustration of the log fabricating process of the present invention.

In FIG. 4, a preferred process for producing the logs 10 is diagrammatically illustrated. The process begins with a rough log 10′ which is introduced into a milling device commonly known in the industry as a Brewer 50, or other similar milling device. As illustrated at 52, the Brewer 50 comprises a top planar which cuts the log 10′ to the desired height. Next, as illustrated at 54, cutting blades cut the top portion 18 of the log 10′ to form the tongues 26 as well as the engaging surface 30, and also cut the upper portions of the side portions 22 and 24 to form arcuate surfaces. As illustrated at 56, cutting blades then cut the bottom portion 20 of the log 10′ to form the grooves 28, as well as the engaging surface 32, and cut the bottom portions of the side portions 22 and 24 to form arcuate surfaces. Of course, the arcuate side portions 22 and 24 which result from steps 54 and 56 give the logs 10 the appearance of logs utilized in authentic log cabins and are primarily optional decorative features.

The log 10′ is then carried, as by a conveyor belt, to the notcher 58. The notcher 58 serves to cut the bottom portion of the log to form one or more saddle notches 34 with the associated tongues 42, as illustrated at 60, and cuts the log 10′ to the desired length as illustrated at 62. Further, if the specifications of the log structure require, a dado groove 46 is cut in the end portion 14 and/or 16 as illustrated at 63. The log 10′ is then conveyed to a top groover 64 which cuts the grooves 44 in the top portion 18 of the log 10 opposite each saddle notch 34, thereby completing the log 10. Of course, such considerations as the number and location of saddle notches 34, the number of dado grooves 46, the length of the logs, etc., are predetermined depending upon the specifications of the log structure to be built.

In light of the above, it will be appreciated that an improved log for the construction of log structures and an associated fabricating method having clear advantages over the prior has been disclosed. In this regard, the utilization of the logs 10 results in a more durable, and better insulated, log structure than those of the prior art, and produces a log structure which is easy and inexpensive to maintain. The tongues 26 and grooves 28 allow the logs to be joined into a solid wall without gaps or cracks, and, similarly, the tongues 42 and grooves 44 join the logs 10 at the seam between the interior surface 40 of the saddle notch 34 and the top portion 18 of an interlocking log 10 so as to produce well insulated corner joints. Moreover, the precutting of the tongues and grooves, 26 and 28, and the tongues and grooves, 42 and 44, obviates the time normally expended properly aligning the logs during construction. It should also be noted that whereas in the preferred illustrated embodiment the logs 10 are provided with two tongues 26 and two grooves 28, it is contemplated that a single tongue 26 and single groove 28 can be utilized if desired. Similarly, a single tongue 42 and single groove 44 can be utilized if desired. However, it will be understood that the double tongue and groove design of the preferred embodiment tends to provide a more stable and better insulated structure.

While a preferred embodiment has been shown and described, it will be understood that there is no intent to limit the invention to such disclosure, but rather it is intended to cover all modifications and alternate constructions falling within the spirit and scope of the invention as defined in the appended claims.

I claim:

1. An improved log for interlocking with other logs for constructing log structures, said improved log comprising:

an elongated body having an exterior surface, said body defining a longitudinal axis and having first and second opposite end portions, a top portion and a bottom portion, said body being provided with a lateral downwardly oriented saddle notch proximate at least one of said end portions for receiving a top portion of another said improved log, said saddle notch defining an inner notch surface conforming in shape to an exterior surface of another said improved log, said notch surface carrying at least one longitudinally oriented tongue projecting into said saddle notch from said notch surface, said body being further provided with at least one laterally oriented groove provided in said exterior surface of said top portion and disposed above said saddle notch of a depth sufficient for closely receiving a tongue in a saddle notch of another said improved log.

2. The improved log of claim 1 wherein said body further comprises at least one longitudinally oriented further tongue disposed on and extending substantially the length of said top portion of said body, and said body is provided with at least one longitudinally oriented further groove disposed in and extending substantially the length of said bottom portion of said body for closely receiving said further tongue of another said improved log.

3. The improved log of claim 1 wherein said saddle notch of said log is provided with a pair of said tongues longitudinally extending from said notch surface of said saddle notch, and wherein said body is provided with a pair of said laterally oriented grooves in said exterior surface of said top portion disposed above said saddle notch of a depth sufficient for closely receiving said tongues on said notch surface of another said improved log.

4. The improved log of claim 2 wherein said saddle notch of said log is provided with a pair of said tongues longitudinally disposed upon said notch surface of said saddle notch, and wherein said body is provided with a pair of said laterally oriented grooves in said exterior surface of said top portion disposed above said saddle notch of a depth sufficient for closely receiving said tongues on said notch surface of another said improved log; and wherein said body is provided with a pair of said longitudinally oriented further tongues disposed on said top portion and a pair of said longitudinally oriented further grooves disposed in said bottom portion for closely receiving said further tongues of another said improved log.

5. The improved log of claim 2 wherein said top portion of said body defines a first planar engaging surface extending substantially the length of said log from which said further tongue extends, and said bottom portion of said body defines a second planar engaging surface extending substantially the length of said log, said second planar engaging surface provided with said further groove, said second planar engaging surface for engaging said first planar engaging surface of another said improved log.

6. The improved log of claim 4 wherein said top portion of said body defines a first planar engaging surface extending substantially the length of said log from which said further tongues extend, and said bottom portion of said body defines a second planar engaging surface extending substantially the length of said log, said second planar engaging surface provided with said further grooves, said second planar engaging surface for engaging said first planar engaging surface of another said improved log.

7. The improved log of claim 1 wherein said second end portion of said body is provided with a dado groove for facilitating the end-to-end joining of said improved log with another said improved log.

8. The improved log of claim 6 wherein said second end portion of said body is provided with a dado groove for facilitating the end-to-end joining of said improved log with another said improved log.

9. An improved log for interlocking with other logs for constructing log structures, said improved log comprising:

an elongated body having an exterior surface, said body defining a longitudinal axis and having first and second opposite end portions, a top portion and a bottom portion, said body being provided with a laterally disposed downwardly oriented saddle notch proximate at least one of said end portions for closely receiving a top portion of another said improved log, said saddle notch defining an inner notch surface conforming to an exterior surface of said top portion of another said improved log, said notch surface carrying a pair of longitudinally oriented tongues projecting into said saddle notch, said body being further provided with a pair of laterally oriented grooves provided in said exterior surface of said top portion and disposed above said saddle notch of a depth sufficient for closely receiving tongues in a saddle notch of another said improved log; and a pair of longitudinally oriented further tongues disposed on said top portion of said body and extending substantially the length of said body, and said body is provided with a pair of longitudinally oriented further grooves disposed in and extending substantially the length of said bottom portion of said body for closely receiving said further tongues of another improved log.

10. The improved log of claim 9 wherein said top portion of said body defines a first planar engaging surface along the length of said body from which said further tongues extend, and said bottom portion of said body defines a second planar engaging surface provided with said further grooves along the length of said body for engaging said first planar engaging surface of another said improved log.

11. The improved log of claim 9 wherein siad second end portion of said body is provided with a dado groove for facilitating the end-to-end joining of said log with another said log.

12. A process for fabricating a log for interlocking with other logs for construction of log structures, said log having an elongated body defining a longitudinal axis and having first and second end portions, a top portion and a bottom portion, said process comprising the steps of:

cutting into said bottom portion of said body a lateral downwardly oriented saddle notch proximate at least one of said end portions for closely receiving said top portion of said body of another said improved log, said saddle notch defining an interior notch surface carrying at least one longitudinally oriented tongue projecting into said saddle notch from said notch surface; and cutting into said exterior surface of said top portion of said body above said saddle notch at least one laterally oriented groove of a depth sufficient for closely receiving a tongue within a saddle notch of another said improved log.

13. The process of claim 12 wherein said saddle notch is cut so as to define a pair of said tongues on said interior notch surface, and wherein a pair of said laterally oriented grooves is cut in said exterior surface of said top portion of said body above said saddle notch.

14. The process of claim 12, and prior to the step of cutting said saddle notch, further including the steps of:

cutting said top portion of said body to form at least one further tongue extending substantially the length of said body; and cutting into said bottom portion of said body at least one further groove extending substantially the length of said body for closely receiving said further tongue of another said log.

15. The process of claim 14 wherein said top portion is cut to form a pair of said further tongues and said bottom portion is cut to form a pair of said further grooves for closely receiving said pair of tongues of another said log.

16. The process of claim 15 wherein said saddle notch is cut so as to define a pair of said longitudinally oriented tongues on said interior notch surface, and wherein a pair of said laterally oriented grooves is cut in said top portion of said body above said saddle notch.

17. The process of claim 16 wherein said step of cutting said top portion to form said further tongues further includes the cutting of said top portion, in relief, to define a first planar engaging surface extending substantially the length of said body from which said further tongues protrude, and wherein said step of cutting said further grooves includes the cutting, in relief, of said bottom portion to define a second planar engaging surface for engaging said first planar engaging surface of another said log.

18. The process of claim 17, and before the step of cutting said laterally oriented grooves in said exterior surface of said top portion of said log for receiving said longitudinally oriented tongues of said saddle notch of an other said log, further including the step of cutting a dado groove in said second end portion of said body.

* * * * *